United States Patent [19]

Waller et al.

[11] B 4,011,809

[45] Mar. 15, 1977

[54] PRESS WITH HYDRAULIC OVERLOAD SAFETY DEVICE AND RAM WEIGHT COUNTERBALANCING MECHANISM

[75] Inventors: Eugen Waller, Goeppingen; Wolfram Büchler, Donzdorf; Rolf Kellenbenz, Goeppingen; Franz Schneider, Goeppingen; Burkhard Schumann, Goeppingen, all of Germany

[73] Assignee: L. Schuler GmbH, Germany

[22] Filed: Mar. 24, 1975

[21] Appl. No.: 561,166

[44] Published under the second Trial Voluntary Protest Program on March 30, 1976 as document No. B 561,166.

[30] Foreign Application Priority Data

Apr. 3, 1974 Germany ..... 2416102
Jan. 15, 1975 Germany ..... 2501275

[52] U.S. Cl. ..... 100/48; 100/53; 100/257; 100/259

[51] Int. Cl.[2] ..... B30B 15/28; B30B 15/14

[58] Field of Search ..... 100/48, 53, 257, 259; 192/12 R

[56] References Cited

UNITED STATES PATENTS 2,748,665 3/1957 Georgeff ..... 100/259 X
3,115,086 12/1963 Stimmel ..... 100/48

FOREIGN PATENTS OR APPLICATIONS 1,348,627 3/1974 United Kingdom ..... 100/259

*Primary Examiner*—Billy J. Wilhite
*Attorney, Agent, or Firm*—Craig & Antonelli

[57] ABSTRACT

A press having mechanical drive elements acting on the ram through at least one pressure cushion serving as a hydraulic overload safety device, at least one cylinder-piston unit operating under the effect of a compressed fluid for counterbalancing the weight of the ram associated with an upper die of the press, and a control system for adjusting fluid pressure in the cylinder-piston unit to a value for counterbalancing the weight. The control system includes a pressure relief valve and a pressure meter associated with the pressure cushion wherein the meter detects the pressure in the pressure cushion in a measuring range including a predetermined value. An actuating member serves for initiating a counterbalancing operation which includes operation of the pressure relief valve and control of supply and discharge valves for supplying and discharging fluid to and/or from the cylinder-piston unit.

20 Claims, 2 Drawing Figures

Figure 1:
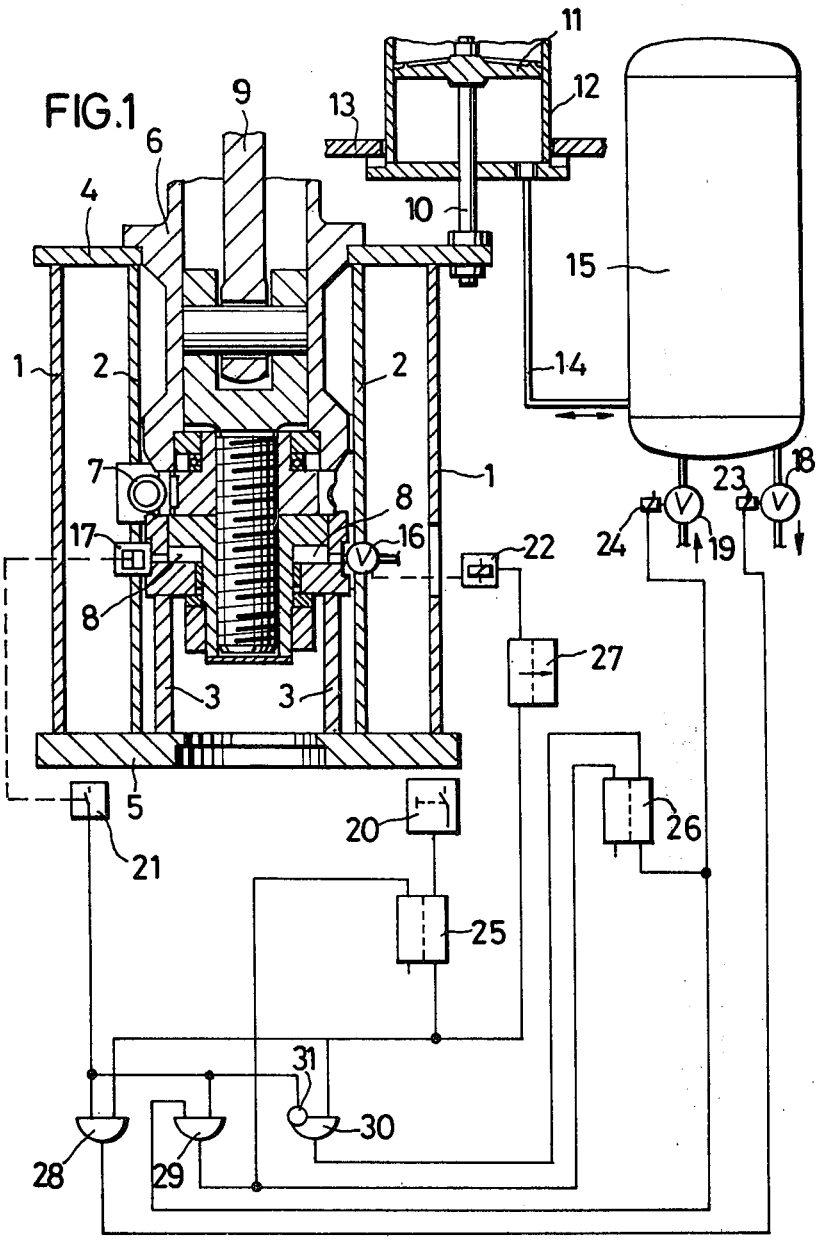

PRESS WITH HYDRAULIC OVERLOAD SAFETY DEVICE AND RAM WEIGHT COUNTERBALANCING MECHANISM

The present invention relates to a press, the mechanical drive elements of which act on the ram by way of at least one pressure cushion fashioned as a hydraulic overload safety device, this press being provided with at least one cylinder-piston unit under the effect of a compressed gas serving for counterbalancing the weight of the ram associated with an upper die, one part of this unit being connected with the ram and the other part being connected with the press frame, wherein a control device is provided for adjusting the gas pressure in the cylinder-piston unit to the valve required for counterbalancing the weight.

A conventional press of this type is disclosed in British Pat. No. 1,348,627 and in DOS (German unexamined laid-open application) No. 2,206,323 and is constructed so that, by triggering the hydraulic overload safety device, the ram can be separated from the mechanical drive elements over a motion range corresponding to the travel path of the overload safety device and the thus-obtained free motion range of the ram can be scanned by sensing elements effective on the control device.

It is an object of the invention to provide a control system, in such a press, for exploiting the hydraulic pressure cushion of the overload safety device proper for influencing the control device.

It is a further object of this invention to provide a control system which reliably maintains the gas pressure in the cylinder-piston unit at a constant value.

The present invention provides an arrangement, in a press of the type mentioned hereinabove, wherein a pressure relief valve operable before setting the gas pressure and a pressure meter having a sensitive detection characteristic in a measuring range including 0 bar are in communication with the pressure cushion, and wherein the pressure relief valve can be operated by the actuating member for setting the gas pressure and the pressure meter is in operative connection with valves for the supply and discharge of compressed gas to and from the cylinder-piston unit, respectively.

The construction of the press in accordance with the present invention yields the following advantageous mode of operation. By actuating the pressure relief valve, the initial pressure of the pressure medium in the pressure cushion required in the working operation of the press for transmitting the operating pressure from the drive elements to the ram is reduced and the filling of the pressure cushion with the pressure medium is maintained without excess pressure. Within the measuring range encompassing 0 bar, control signals are then derived by means of the pressure meter and these signals effect the adjustment of the gas pressure to the valve necessary to counterbalance the weight by way of valves for the supply and discharge of compressed gas.

A feature of the press according to the present invention resides in that a pressure meter which detects only pressures higher than 0 bar is followed by a control arrangement which, upon the original or initial presence of a pressure higher than 0 bar, regulates the valve effecting the discharge of pressurized gas in the manner of opening such valve, by way of the operative connection, and which, upon the original absence of a pressure higher than 0 bar, first regulates the valve effecting the supply of compressed gas in the manner of opening such valve. Upon the subsequent attainment of a pressure of higher than 0 bar, the control arrangement regulates the last-mentioned valve in the manner of closing same and regulates the valve effecting the discharge of compressed gas in the manner of opening same, by way of the operative connection, and which, furthermore, regulates the valve effecting the discharge of compressed gas, by way of the operative connection, in the manner of closing such valve upon the subsequent disappearance of the pressure of higher than 0 bar.

Another feature of the press according to the present invention resides in that a control arrangement is connected after a pressure meter detecting only pressures higher than 0 bar, which control arrangement regulates, upon the original or initial presence of a pressure higher than 0 bar, the valve effecting the discharge of compressed gas so that such valve is opened and, upon the disappearance of this pressure, regulates this valve so that it is closed, by way of the operative connection. Further, upon the subsequent or original absence of a pressure higher than 0 bar, the control arrangement regulates the valve effecting the supply of compressed gas so that it is opened and, upon reaching a pressure high than 0 bar, regulates this valve so that it is closed, by way of the operative connection.

By constructing the press in this way, the difficulties are avoided which result purely for reasons of measuring technology during the detection of a pressure lying under 0 bar in the pressure cushion. In one case, the control arrangement has the effect that, upon the original absence of a pressure higher than 0 bar, such a pressure is first of all attained and that the adjustment of the correct value for the gas pressure is always accomplished during the course of reducing the pressure in the pressure cushion to 0 bar. In contrast thereto, in the other case, the control arrangement has the effect that, upon the original presence of a pressure higher than 0 bar, the pressure in the pressure cushion is first reduced to a value lying at 0 bar and that the setting of the correct value for the gas pressure is always accomplished during the course of increasing the pressure in the pressure cushion to above 0 bar. It is possible, in this connection, to make use of the inertia of the regulating device which is present anway, or to intentially increase such inertia, if necessary, for the purpose of attaining first of all a pressure in the pressure cushion which forms the starting point for adjusting the gas pressure to the correct value, during the course of a reduction or increase of the pressure in the pressure cushion to and/or above 0 bar.

However, an inertia of the regulating device, which is present anyway, also has the effect in the last-described regulating step that, depending on the direction of approach to the pressure of 0 bar, a somewhat too low or a somewhat too high value of the gas pressure is set in the pressure cushion. To compensate for this inaccuracy, the control arrangement can advantageously be provided with an additional switching member which, after termination of the aforedescribed control process, operates the valve effecting the supply of compressed gas or the valve effecting the discharge of compressed gas so that such valve is opened for a predetermined time and is thereafter closed, with the predetermined time being adapted to the given inertia of the regulating device.

According to an advantageous embodiment of the present invention, there are provided a generator for providing an electric signal proportional to the gas pressure in the cylinder-piston unit, a setting member which is operable by the generator by way of a comparison circuit, a storage element of the comparison circuit settable to a signal corresponding to the gas pressure required for weight balancing, servo members operable by the comparison circuit on the basis of deviations of the signal present at the generator with the signal preset in the storage element in the correct sense of direction for the control of valves serving for the supply and discharge of compressed gas to and from the cylinder-piston unit, respectively, and switching elements arranged such that selectively the setting member and the servo members can be inserted in the comparison circuit.

The mode of operation of this control system resides basically in that, in one position of the switching elements, the generator sets the storage element by means of the comparison circuit and by way of the setting member to the signal corresponding to the gas pressure required for weight balancing, and, in the other position of the switching elements, the generator regulates, via the comparison circuit by means of the servo members, by the supply and discharge of compressed gas to and from the cylinder-piston unit, the gas pressure in the latter to a value required for weight balancing. Since, with this control system, a continuous or frequently repeated regulation of the gas pressure in the cylinder-piston unit to the value necessary for weight balancing can be executed in a simple manner, losses of compressed gas in the cylinder-piston unit, e.g., by leakage, or variations of the gas pressure in the cylinder-piston unit, e.g., by temperature fluctuations, are compensated for at maximum speed and thus disturbances are avoided. Of course, the reduction of the initial pressure in the pressure cushion, provided for the initiation of the weight counterbalancing step, by means of the pressure relief valve, takes place only while the generator sets the storage element, whereas the regulation of the gas pressure to the set value can be carried out while the initial pressure in the pressure cushion has the value required for transmitting the operating pressure from the drive elements to the ram.

According to another feature of the present invention, the comparison circuit is fashioned as a Wheatstone bridge wherein the bridge diagonal connects an adjustable tap of a first potentiometer pertaining to two bridge branches and effective as a generator with an adjustable tap of a second potentiometer pertaining to the other two bridge branches and effective as a storage device, the tap of the first potentiometer being adjustable by the gas pressure in the cylinder-piston unit, and the tap of the second potentiometer being adjustable by a motor effective as a setting member, and wherein the bridge diagonal can be selectively connected by the switching elements with the motor and with the servo members. Additionally, an amplifier can be provided in the bridge diagonal.

Figure 2:
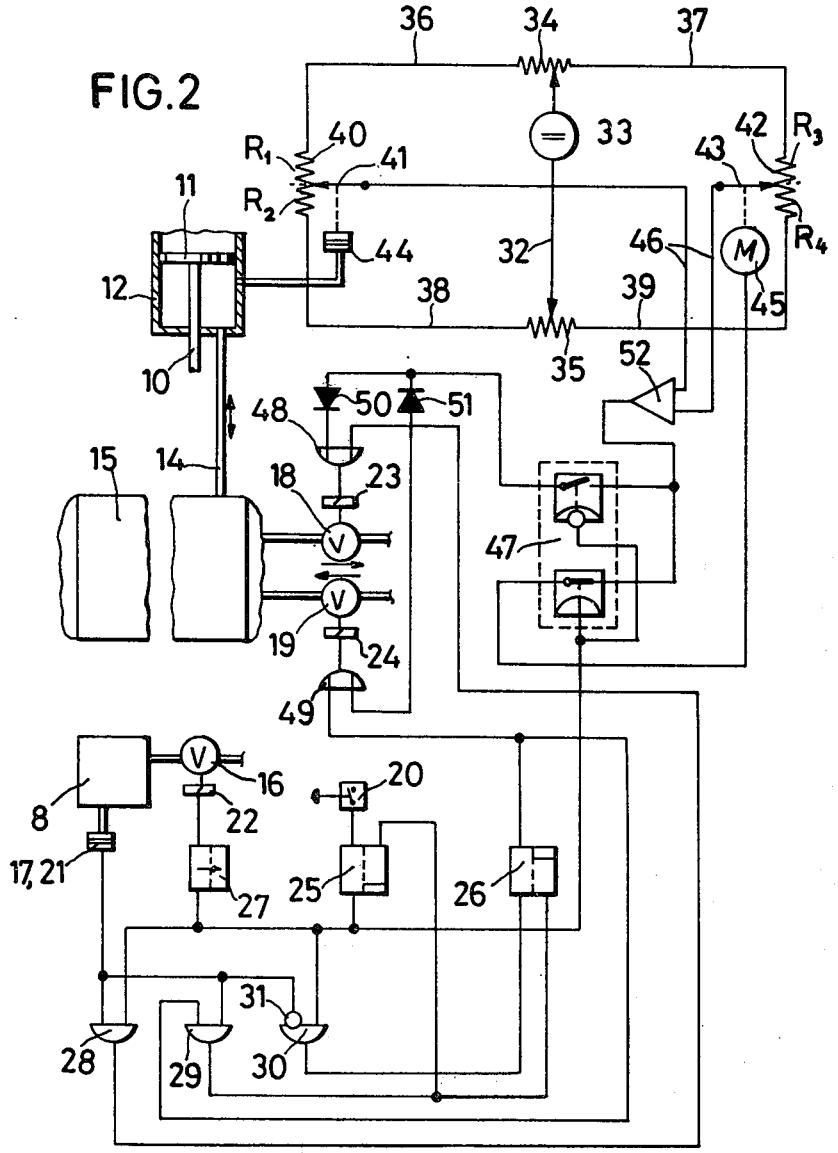

The above discussed and other objects, features and advantages of the present invention will become more apparent from the following description thereof, when taken in connection with the accompanying drawings, wherein;

FIG. 1 illustrates the ram of the press and the cylinder-piston unit serving for ram weight counterbalancing in a sectional view, a compressed-gas tank in an elevational view, and the control system in a schematic view, with a logic circuit in block diagram form; and FIG. 2 illustrates a control system according to FIG. 1 with a comparison circuit arrangement.

Referring now to the drawings wherein like reference numerals are utilized to designate like parts throughout the several views, there is shown in FIG. 1 a press ram comprising outer walls 1, inner walls 2, 3, a top plate 4, a bottom plate 5, and an inner supporting body 6 as the main components and being provided with a ram adjusting device 7 and a pressure cushion 8 fashioned as a hydraulic overload safety device. The operating pressure is introduced by a connecting rod 9 and can be transmitted by way of the pressure cushion 8 to the ram. During the working operation of the press, the pressure medium in the pressure cushion 8 is under the necessary initial pressure. A pressure relief valve 16 and a pressure meter 17 are connected to the pressure cushion 8.

A piston rod 10 of a cylinder-piston unit 11, 12 which serves for ram weight counterbalancing is attached to the top plate 4 of the ram and the cylinder 12 of this unit is fixedly joined to the frame 13 of the press. The interior of cylinder 12 is in communication with a compressed-gas tank 15 by way of a pipeline 14. A valve 18 which serves for the discharge of compressed gas and a valve 19 which serves for the supply of compressed gas are connected to the compressed-gas tank 15.

An actuating member 20 is provided which serves for the initiation, for example, manual initiation of the setting of the gas pressure by means of the regulating device. The pressure meter 17 as shown in FIG. 1 is in operative connection with a signal generator 21 which yields a signal in case of the presence of a pressure in the pressure cushion 8 of greater than 0 bar. As further shown in FIG. 1, the pressure relief valve 16 is in operative connection with a servo member 22 whereas the valve 18 serving for the discharge of compressed gas is in operative connection with a servo member 23 and the valve 19 serving for the supply of compressed gas is in operative connection with a servo member 24.

A logic control circuit arrangement for controlling operation of the counterbalancing mechanism is illustrated in FIGS. 1 and 2. The logic circuit includes bistable multivibrators or flip-flops 25, 26, a timing member 27, three AND-gates 28, 29, 30, wherein the AND-gate 30 has a reversing stage or inverter 31 at one input thereof and the logic circuit has the following mode of operation. By actuating the operating member 20, the flip-flop 25 is set or made conductive whereby the signal appearing at the output thereof controls, via the timing member 27, the servo member 22 for a predetermined period of time and effects the opening of the pressure relief valve 16 for the predetermined period of time. The signal appearing at the output of the flip-flop 25 is furthermore applied to the inputs of the AND-gates 28 and 30. Upon the presence of a pressure higher than 0 bar in the pressure cushion 8, the signal generator 21 is triggered by the pressure meter 17 and emits a signal at its output which is applied to the inputs of AND-gates 28 and 29 and which is not applied to the AND-gate 30 due to the interposed inverter stage 31. Thus, the AND-gate 28 delivers a signal at its output which controls, via an OR-gate 48 (FIG. 2), the servo member 23 and opens the valve 18 — discharge of compressed gas — and maintains this valve in the open position until the latter is closed on the basis of a reduction in pressure in the pressure cushion 8 to 0 bar due to the disappearance of the signal on the output side of the AND-gate 28. Because of the disappearance of the signal of the signal generator 21, a signal is now formed on the output side of the AND-gate 30 due to the effect of the inverter stage 31, this signal setting or rendering the flip-flop 26 conductive and thus controlling the servo member 24 via an OR-gate 49 (FIG. 2), opening the valve 19 — supply of compressed gas — and maintaining this valve in the open position until the signal on the output side of the flip-flop 26 has disappeared. When the pressure in the pressure cushion 8 has increased to above 0 bar, a signal is again generated by the signal generator 21 and applied at one input of the AND-gate 29 which has the signal from the output of the flip-flop 26 applied to the other input thereof, whereby an output signal is formed at the AND-gate 29 which resets the flip-flops 25, 26 and thus terminates the regulating procedure.

If, upon the operation of the actuating member 20, the pressure in the pressure cushion 8 is not higher than 0 bar, the regulating procedure takes place in the same manner, but omitting the first control step.

Furthermore, the control circuit contains a comparison circuit designed as a Wheatstone bridge as illustrated in FIG. 2. The supply diagonal 32 of the Wheatstone bridge contains a source of d.c. current 33 and is connected, via the taps of infinitely variable potentiometers 34, 35, with the junctions of respectively two adjacent bridge branches 36 and 37, as well as 38 and 39, respectively. The adjustability of the potentiometers 34, 35 is utilized only for the basic adjustment and for the possible subsequent adjustment of the comparison circuit.

A potentiometer 40 effective as a generator or transducer forms, with its infinitely variable tap 41, the junction of the bridge branches 36 and 38, whereas a potentiometer 42, effective as storage device, forms the junction of the bridge branches 37 and 39 with its infinitely variable tap 43. The formed resistance $R_1$, $R_2$, $R_3$, and $R_4$are variable in correspondence with the respective positions of the taps 41 and 43 at the potentiometers 40 and 42 constitute respectively components of the associated bridge branches 36, 37, 38 and 39. The tap 41 at the potentiometer 40 is in operative connection via a pressure sensor 44 with the cylinder-piston unit 11, 12, so that the tap 41 is adjusted in correspondence with the gas pressure in the cylinder-piston unit. Furthermore, the tap 43 at the potentiometer 42 is in operative connection with the motor 45 serving as the setting member, so that the tap 43 is adjusted in correspondence with the actuation of the motor 45.

The bridge diagonal 46 formed between the taps 41 and 43 at the potentiometers 40 and 42 is selectively connectable, by means of switching elements 47, with the motor 45 or, via the OR-gates 48, 49, with the servo members 23 and 24, respectively, which are in operative connection with the valves 18 and 19, respectively. The servo members 23 and 24 are associated with rectifiers 50 and 51 disposed in front of the OR-gates 48 and 49, respectively. The rectifiers serve for insuring that respectively only one of the servo members 23 and 24 is operated. The amplifier 52 serves for the amplification of the control voltage for the motor 45 or the servo members 23 and 24, formed respectively in the bridge diagonal 46.

The switching elements 47 connect, in dependence on the output of the flip-flop 25, the output of the amplifier 52 with the motor 45 or, by way of the rectifiers 50, 51 and the OR-gates 48, 49, with the servo members 23, 24 of the valves 18, 19.

In the position of the switching elements 47 as illustrated in FIG. 2, wherein the bridge diagonal 46 is connected to the motor 45, the balancing effect is achieved by the step that the motor 45 adjusts the tap 43 at the potentiometer 42, whereby the gas pressure determined as being necessary for weight compensation in the cylinder-piston unit 11, 12 is stored, in the form of the corresponding electric signal produced at the potentiometer 40 as the signal generator, with the potentiometer 42 serving as the storage device. In the other position of the switching elements 47, wherein the bridge diagonal 46 is connected to the servo members 23 and 24, the balancing effect is achieved by the step that, with a positioned tap 43, compressed gas is fed to the cylinder-piston unit 11, 12 through the valve 19 or discharged therefrom through the valve 18, on account of the actuation by the servo members 23 and 24, respectively, until the gas pressure required for weight balancing is set in the cylinder-piston unit 11, 12 and accordingly the tap 41 is in the corresponding position.

In the former case — motor 45 is connected to the output of amplifier 52 by way of the switching elements 47 — the pressure in the cylinder-piston unit 11, 12 determined by the arrangement of elements 1–31 and corresponding to the correct ram weight counterbalancing action is transmitted via the potentiometer 40 effective as a generator to the potentiometer 42 effective as a storage device. During this step, the flip-flop 25 is in the set condition. As soon as the correct pressure for the ram weight balancing action has been attained in the cylinder-piston unit 11, 12, the flip-flop 25 is reset, whereby the switching element 47 connect the bridge diagonal 46 with the servo members 23, 24 by way of the amplifier 52. The pressure in the cylinder-piston unit 11, 12 corresponding to the position of the potentiometer 42 effective as a storage device is now maintained constant by means of the aforedescribed circuit 32–52.

Obviously, many modifications and variations of the present invention are possible in the light of the above teachings. It should therefore be understood that within the scope of the appended claims the invention may be practiced otherwise than as specifically described.

We claim:

1. A press comprising mechanical drive elements acting on a ram through at least one pressure cushion serving as a hydraulic overload safety device, at least one cylinder-piston unit means operating under the effect of a compressed fluid for counterbalancing the weight of the ram associated with an upper die of the press, and a control system for adjusting fluid pressure in the cylinder-piston unit means to a value for counterbalancing the weight, this control system including pressure relief valve means and pressure meter means associated with the pressure cushion, the pressure relief valve means being operable before setting of the fluid pressure value for release of pressure from the pressure cushion, the pressure meter means accurately detecting the pressure in the pressure cushion in a measuring range including a predetermined value, actuating means for initiating the setting of a fluid pressure value for counterbalancing the weight, the pressure relief valve means being responsive to the actuating means for operation thereof, and supply valve means and discharge valve means for supplying and discharging compressed fluid to and/or from the cylinder-piston unit means, the supply and discharge valve means being responsive to the actuating means and the pressure meter means for operation thereof.

2. A press according to claim 1, wherein the cylinder-piston unit means has one portion thereof connected with the ram and the other portion thereof connected with a frame of the press, the cylinder-piston unit means operating under the effect of a compressed gas.

3. A press according to claim 1, wherein the control system includes control means responsive to the pressure meter means for controlling the supply and discharge valve means:

the control means operating the discharge valve means to effect discharge of fluid from the cylinder-piston unit means upon the detection of initial presence of a pressure higher than the predetermined valve in the pressure cushion and to stop the discharge of fluid upon the subsequent detection of the absence of a pressure higher than the predetermined value in the pressure cushion;

the control means also operating the supply valve means to effect supply of fluid to the cylinder-piston unit means upon the detection of the initial absence of a pressure higher than the predetermined value in the pressure cushion, the control means upon the subsequent detection of a pressure higher than the predetermined value in the pressure cushion operating the supply valve means and the discharge valve means to stop the supply of fluid to the cylinder-piston unit means and initiate discharge of fluid therefrom, the control means upon detection of the absence of a pressure higher than the predetermined value controlling the discharge valve means to stop the discharge of fluid from the cylinder-piston unit means.

4. A press according to claim 3, wherein said pressure meter means only provides an output to the control means upon detection of pressures higher than the predetermined value, the predetermined value being 0 bar.

5. A press according to claim 4, wherein the control means includes timing means for controlling at least one of the supply valve means and the discharge valve means after the operation of the supply valve means and the discharge valve means has been stopped due to attainment of a pressure of 0 bar to effect one of the supply and discharge of fluid for a predetermined time.

6. A press according to claim 1, wherein the control system includes generator means for providing a signal value proportional to the fluid pressure in the cylinder-piston unit means, comparison circuit means, setting means responsive to the comparison circuit means for setting a storage means to a value corresponding to the fluid pressure required for weight balancing, servo means responsive to the output of the comparison circuit means corresponding to the difference of value of the generator means and the storage means for controlling the supply and discharge valve means to effect supply and discharge of fluid to and from the cylinder-piston unit means, respectively, and switching means for selectively connecting the setting means and the servo means with the comparison circuit means.

7. A press according to claim 6, wherein the comparison circuit means includes a wheatstone bridge having four bridge branches and a bridge diagonal, the generator means including a first potentiometer connected to two bridge branches and the storage means including a second potentiometer connected to the other two bridge branches, the bridge diagonal connecting an adjustable tap of the first potentiometer with an adjustable tap of the second potentiometer, the tap of the first potentiometer being adjustable by the fluid pressure in the cylinder-piston unit means, the setting means including a motor for adjusting the tap of the second potentiometer, the switching means selectively connecting the bridge diagonal with one of the motor and the servo means.

8. A press according to claim 7, further comprising amplifier means connected to the bridge diagonal for supplying an amplified output signal to one of the motor and the servo means in accordance with the connection of the switching means.

9. A press according to claim 7, wherein the servo means are responsive to the plurality of the signal in the bridge diagonal for controlling one of the supply and discharge valve means.

10. A press according to claim 7, wherein the control system includes control means responsive to the pressure meter means for controlling the supply and discharge valve means:

the control means operating the discharge valve means to effect discharge of fluid from the cylinder-piston unit means upon the detection of initial presence of a pressure higher than the predetermined value in the pressure cushion and to stop the discharge of fluid upon the subsequent detection of the absence of a pressure higher than the predetermined value in the pressure cushion;

the control means also operating the supply valve means to effect supply of fluid to the cylinder-piston unit means upon the detection of the initial absence of a pressure higher than the predetermined value in the pressure cushion, the control means upon the subsequent detection of a pressure higher than the predetermined value in the pressure cushion operating the supply valve means and the discharge valve means to stop the supply of fluid to the cylinder-piston unit means and initiate discharge of fluid therefrom, the control means upon detection of the absence of a pressure higher than the predetermined value controlling the discharge valve means to stop the discharge of fluid from the cylinder-piston unit means.

11. A press according to claim 10, wherein said pressure meter means only provides an output to the control means upon detection of pressures higher than the predetermined value, the predetermined value being 0 bar.

12. A press according to claim 11, wherein the actuating means includes a switching member for setting a first flip-flop providing an output to a timing member for controlling the operation of the pressure relief valve means for a predetermined time, and the control means includes first, second and third AND gates, each of the AND gates having two inputs and the third AND gate having an inverter at one input thereof, the first flip-flop set by the actuating means providing an output to an input of the first and third AND gates, the pressure meter means including a pressure meter and a signal generator for providing an output to the other input of the first AND gate, one input of the second AND gate and the inverter input of the third AND gate, the first AND gate providing an output to the discharge valve means, the third AND gate providing an output for setting a second flip-flop providing an output to the supply valve means and to the other input of the second AND gate, the second AND gate providing an output for resetting the flip-flop set by the actuating means and for resetting the flip-flop actuated by the third AND gate.

13. A press according to claim 12, wherein the first flip-flop set by the switching member serves for controlling the selective connection of the switching means for connecting the output of the bridge diagonal to one of the motor and the servo members.

14. A press according to claim 1, wherein the control system includes control means responsive to the pressure meter means for controlling the supply and discharge valve means:

the control means controlling the discharge valve means to effect discharge of fluid from the cylinder-piston unit means upon the detection of the initial presence of a pressure higher than the predetermined value in the pressure cushion and for controlling the discharge valve means so as to stop the discharge of fluid upon detection of the absence of a pressure higher than the predetermined value and;

the control means controlling the supply valve means to effect the supply of fluid to said cylinder-piston unit means upon at least one of initial and subsequent detection of the absence of a pressure higher than the predetermined value in the pressure cushion and to stop the supply of fluid upon detection of a pressure higher than the predetermined value.

15. A press according to claim 14, wherein the pressure meter means only provides an output to the control means upon detection of pressures higher than the predetermined value, the predetermined value being 0 bar.

16. A press according to claim 14, wherein the control means includes timing means for controlling at least one of the supply valve means and the discharge valve means after the operation of the supply valve means and the discharge valve means has been stopped due to attainment of a pressure of 0 bar to effect one of the supply and discharge of fluid for a predetermined time.

17. A press according to claim 7, wherein the control system includes control means responsive to the pressure meter means for controlling the supply and discharge valve means:

the control means controlling the discharge valve means to effect discharge of fluid from the cylinder-piston unit means upon the detection of the initial presence of a pressure higher than the predetermined value in the pressure cushion and for controlling the discharge valve means so as to stop the discharge of fluid upon detection of the absence of appressure higher than the predetermined value and;

the control means controlling the supply valve means to effect the supply of fluid to said cylinder-piston unit means upon at least one of initial and subsequent detection of the absence of a pressure higher than the predetermined value in the pressure cushion and to stop the supply of fluid upon detection of a pressure higher than the predetermined value.

18. A press according to claim 17, wherein the pressure meter means only provides an output to the control means upon detection of pressures higher than the predetermined value, the predetermined value being 0 bar.

19. A press according to claim 18, wherein the actuating means includes a switching member for setting a first flip-flop providing an output to a timing member for controlling the operation of the pressure relief valve means for a predetermined time, and the control means includes first, second and third AND gates, each of the AND gates having two inputs and the third AND gate having an inverter at one input thereof, the first flip-flop set by the actuating means providing an output to an input of the first and third AND gates, the pressure meter means including a pressure meter and a signal generator for providing an output to the other input of the first AND gate, one input of the second AND gate and the inverter input of the third AND gate, the first AND gate providing an output to the discharge valve means, the third AND gate providing an output for setting a second flip-flop providing an output to the supply valve means and to the other input of the second AND gate, the second AND gate providing an output for resetting the flip-flop set by the actuating means and for resetting the flip-flop actuated by the third AND gate.

20. A press according to claim 19, wherein the first flip-flop set by the switching member serves for controlling the selective connection of the switching means for connecting the output of the bridge diagonal to one of the motor and the servo members.

* * * * *